US010320159B2

(12) United States Patent
Shimizu et al.

(10) Patent No.: US 10,320,159 B2
(45) Date of Patent: Jun. 11, 2019

(54) HIGH FREQUENCY DISCHARGE IGNITION DEVICE

(71) Applicant: Mitsubishi Electric Corporation, Tokyo (JP)

(72) Inventors: Yasuyuki Shimizu, Tokyo (JP); Takaaki Tanaka, Tokyo (JP); Akira Nakagawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/710,899

(22) Filed: Sep. 21, 2017

(65) Prior Publication Data

US 2018/0278027 A1 Sep. 27, 2018

(30) Foreign Application Priority Data

Mar. 23, 2017 (JP) ..... 2017-057212

(51) Int. Cl.

| | |
|---|---|
| ***F02P 3/02*** | (2006.01) |
| ***H01T 13/41*** | (2006.01) |
| ***H01T 13/08*** | (2006.01) |
| ***H01T 13/06*** | (2006.01) |
| ***H01T 13/44*** | (2006.01) |
| ***F02P 3/01*** | (2006.01) |
| *H01F 38/12* | (2006.01) |

(52) U.S. Cl.

CPC ..... *H01T 13/41* (2013.01); *F02P 3/01* (2013.01); *H01T 13/06* (2013.01); *H01T 13/08* (2013.01); *H01T 13/44* (2013.01); *F02P 3/02* (2013.01); *H01F 38/12* (2013.01)

(58) Field of Classification Search

CPC ..... H01T 13/41; H01T 13/06; H01T 13/08; H01T 13/44; H01T 13/05; F02P 3/02; H01F 38/12

USPC ..... 123/635, 647, 601, 605, 618

See application file for complete search history.

(56) References Cited

U.S. PATENT DOCUMENTS

| | | | | |
|---|---|---|---|---|
| 6,494,193 | B2 * | 12/2002 | Weingaertner | F02F 1/242 123/143 C |
| 2008/0149083 | A1 * | 6/2008 | Katoh | F02P 9/007 123/634 |

FOREIGN PATENT DOCUMENTS

| | | | |
|---|---|---|---|
| JP | 2008-175197 | A | 7/2008 |
| JP | 2011-132897 | A | 7/2011 |
| JP | 5250119 | B2 | 7/2013 |

OTHER PUBLICATIONS

Communication dated Feb. 13, 2018 issued by the Japanese Patent Office in counterpart application No. 2017-057212.

* cited by examiner

*Primary Examiner* — Hai H Huynh
*Assistant Examiner* — Gonzalo Laguarda
(74) *Attorney, Agent, or Firm* — Sughrue Mion, PLLC; Richard C. Turner

(57) ABSTRACT

By grounding a metal first housing, radiation noise generated from the coupling circuit is shielded. Further, by enclosing the first housing in a metal second housing in a manner such that the first housing and the second housing do not come into contact with each other, and grounding the second housing by connecting the second housing to an engine block, radiation noise generated by the capacitive component between the coupling circuit and the first housing is shielded by the second housing. As a result, the influence of this noise on peripheral devices of the high frequency discharge ignition device can be suppressed.

20 Claims, 10 Drawing Sheets

HIGH FREQUENCY DISCHARGE IGNITION DEVICE

BACKGROUND OF THE INVENTION

1. Field of the Invention

The present invention relates to a high frequency discharge ignition device to be used mainly in an internal combustion engine.

2. Description of the Related Art

In recent years, problems relating to environmental conservation and fuel depletion have been raised, and responding to these problems also represents an urgent task in the automobile industry. As an example of a response thereto, there exists a method in which fuel consumption is improved through engine downsizing using a supercharger.

However, when a supercharger is used and a highly supercharged state is reached, pressure in an engine combustion chamber becomes extremely high even in a state where combustion is not occurring, making it difficult to generate a spark discharge for initiating combustion. As a solution to this, a state in which a spark discharge can be generated easily is created by narrowing the gap of a spark plug. However, when the gap of the spark plug is narrowed, quenching effect caused by the electrode part, that is, an effect where energy that allows a just generated spark to grow is depleted by the low-temperature electrode part, becomes more pronounced, which results in a decrease of startability or a combustibility.

In order to solve this problem, a method has been considered in which energy that exceeds the thermal energy depleted by the quenching effect is provided by spark discharge. For example, Japanese Patent No. 5250119 describes a high frequency discharge ignition device that enables a high-energy spark discharge to be formed by supplying, to a spark plug, high frequency energy having a high voltage and acquired as a result of coupling high frequency energy boosted by a booster circuit to a spark discharge generated by an ignition coil.

SUMMARY OF THE INVENTION

However, with the high frequency discharge ignition device described in Japanese Patent No. 5250119, a capacitive component is generated between a coupling circuit and a first metal housing into which the coupling circuit is built. A problem thus exists in that when a potential difference occurs between both ends of the capacitive component such that a capacitive discharge current flows thereacross, the capacitive component emits radiation noise to the outside, causing peripheral devices to malfunction.

The present invention has been made to solve the above-mentioned problem, and an object thereof is to provide a high frequency discharge ignition device in which the influence of radiation noise on peripheral devices thereof is reduced.

A high frequency discharge ignition device according to the present invention is a high frequency discharge ignition device in which high frequency energy supplied from a high frequency energy supply circuit is coupled to a high voltage pulse supplied from an ignition coil and supplied to a spark plug connected to an engine block, the high frequency discharge ignition device including: an output device that includes a coupling circuit supplying the coupled energy to the spark plug; a first housing in which the output device is housed; and a second housing that is connected to the engine block, wherein the output device is directly attached to the spark plug, the first housing and the second housing are respectively formed from metal, the first housing is grounded, the first housing is enclosed in the second housing, and the first housing is separated from the second housing by a gap.

With the high frequency discharge ignition device of the present invention, a first housing which houses a coupling circuit is grounded. A second housing is connected to the engine block and thus grounded. The second housing encloses the first housing in a manner so as not to come into contact with the first housing. As a result, the second housing can be formed so as not to allow radiation noise generated by the capacitive discharge current between the coupling circuit and the first housing to escape to the outside of the second housing.

As a result, a high frequency discharge ignition device can be provided in which the influence of radiation noise on peripheral devices thereof is reduced.

DESCRIPTION OF THE PREFERRED EMBODIMENTS

Figure 1:
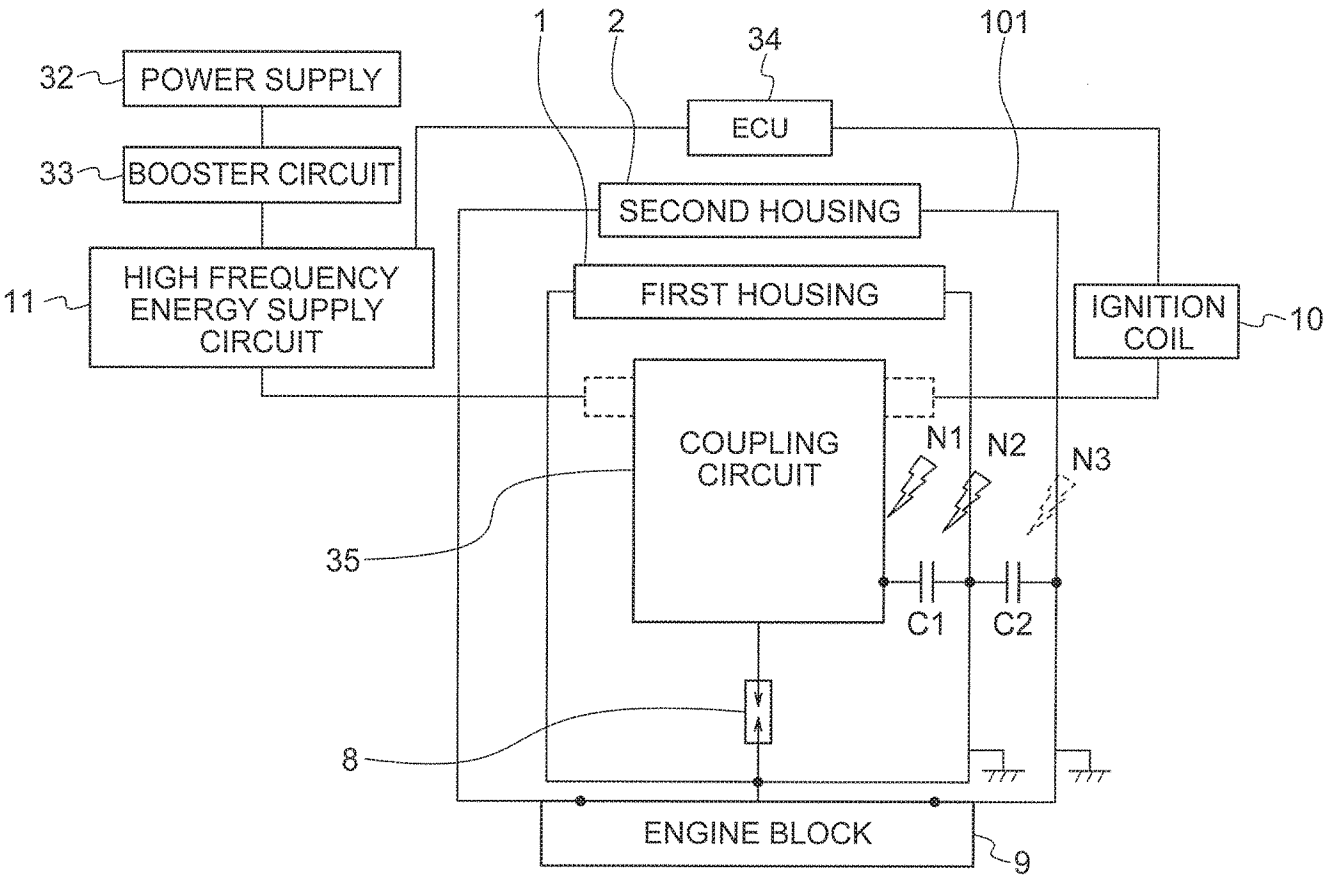
FIG. 1 is a block diagram showing a circuit configuration of a high frequency discharge ignition device according to a first embodiment of the present invention.

Embodiments of the high frequency discharge ignition device according to the present invention will be described hereinafter with reference to the drawings. Note that identical or corresponding parts will be indicated by identical reference numerals, and redundant description is omitted.

Further, in these embodiments, the voltage of a "high voltage pulse" is assumed to be 30 to 40 kV, the voltage of "high frequency energy" is assumed to be 1 to 2 kV, and the frequency of a "high frequency" is assumed to be several hundred kHz to several MHz.

First Embodiment

FIG. 1 is a block diagram showing a circuit configuration of a high frequency discharge ignition device 101 and peripheral devices thereof according to a first embodiment. The high frequency discharge ignition device 101 is constituted by a coupling circuit 35, a first housing 1 and a second housing 2. The coupling circuit 35 is housed in the first housing 1. The first housing 1 is enclosed in the second housing 2.

The voltage of a power supply 32 is boosted by a booster circuit 33. Using the boosted voltage, a high frequency energy supply circuit 11 generates and supplies high frequency energy to the coupling circuit 35. In addition, an ignition coil 10 generates and supplies a high voltage pulse to the coupling circuit 35. The coupling circuit 35 couples and supplies, to a spark plug 8 connected to an engine block 9, the high frequency energy and the high voltage pulse. Drive control of the high frequency energy supply circuit 11 and a circuit of the ignition coil 10 is performed by an ECU 34.

Three types of radiation noise, N1 to N3, are dealt with hereinafter in this specification.

First radiation noise N1 is radiation noise generated by the coupling circuit 35.

Second radiation noise N2 is radiation noise generated due to a capacitive component C1 between the coupling circuit 35 and the first housing 1. When a potential difference occurs between both ends of the capacitive component C1, a capacitive discharge current flows thereacross, causing radiation of the second radiation noise N2.

Third radiation noise N3 is radiation noise generated due to a capacitive component C2 between the first housing 1 and the second housing 2. When a potential difference occurs between both ends of the capacitive component C2, a capacitive discharge current flows thereacross, causing radiation of the third radiation noise N3.

The configuration of the high frequency discharge ignition device 101 will be described hereinafter with reference to FIGS. 2 to 4.

Figure 2:
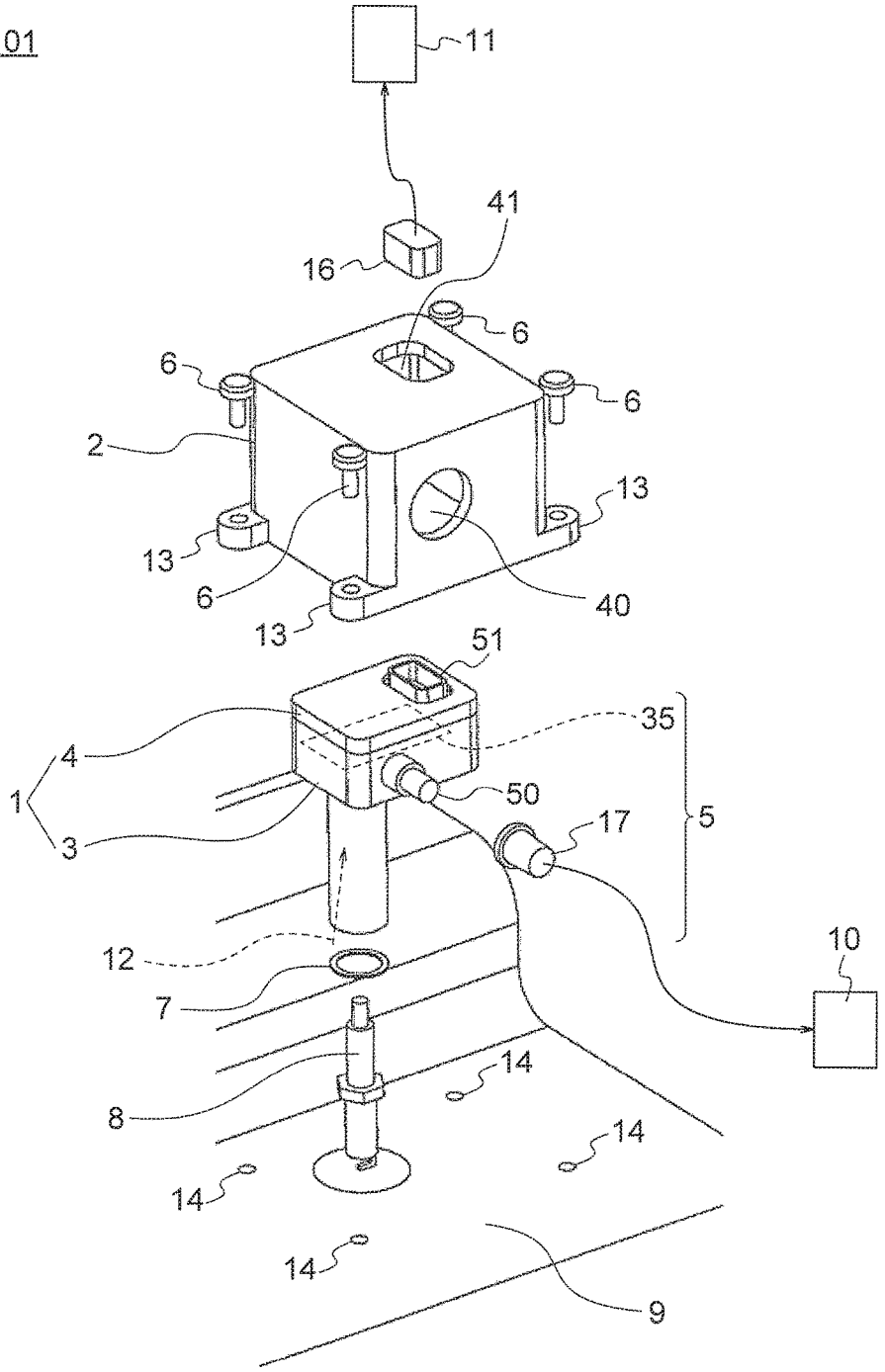
FIG. 2 is an exploded perspective view of the high frequency discharge ignition device according to the first embodiment.

FIG. 2 is an exploded perspective view showing an internal structure of the high frequency discharge ignition device 101.

The spark plug 8 is attached to the engine block 9. Four female threaded portions 14 are provided around the area in which the spark plug 8 is attached. The four female threaded portions 14 are used when fixing the second housing 2 in place.

The first housing 1 is formed by a base 3 and a cover 4, and houses an output device 5. The output device 5 is constituted by the coupling circuit 35, a protector 12, a connection terminal 50, and a connection terminal 51. The coupling circuit 35 is screwed into the first housing 1. The protector 12 is mounted on the spark plug 8. In other words, the output device 5 is electrically connected directly to the spark plug 8. The connection terminal 50 is connected to the ignition coil 10 via a harness 17. The connection terminal 51 is connected to the high frequency energy supply circuit 11 via a harness 16.

The second housing 2 is provided to the outside of the first housing 1 so as to enclose the first housing 1 with a gap disposed therebetween. The second housing 2 is provided with a hole 40, a hole 41, and four flange holes 13. Bolts 6 pass through each of the four flange holes 13. The bolts 6 are fastened to each of the female threaded portions 14 in the engine block 9. In this way, the second housing 2 is connected to the engine block 9. The harness 17, which is directed towards the ignition coil 10, passes through the hole 40. The harness 16, which is directed towards the high frequency energy supply circuit 11, passes through the hole 41.

Note that the first housing 1 and the second housing 2 are formed from metal. Aluminum or stainless steel, for example, may be used as a material therefor.

Figure 3:
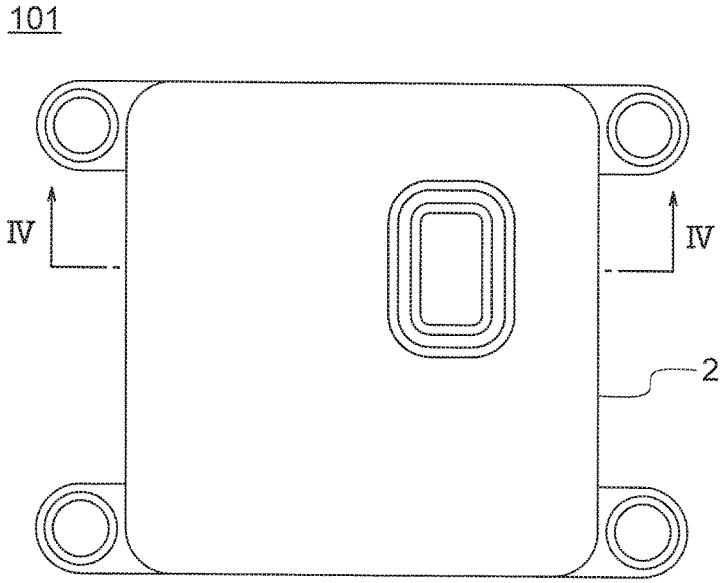
FIG. 3 is a top view of the high frequency discharge ignition device according to the first embodiment.
Figure 4:
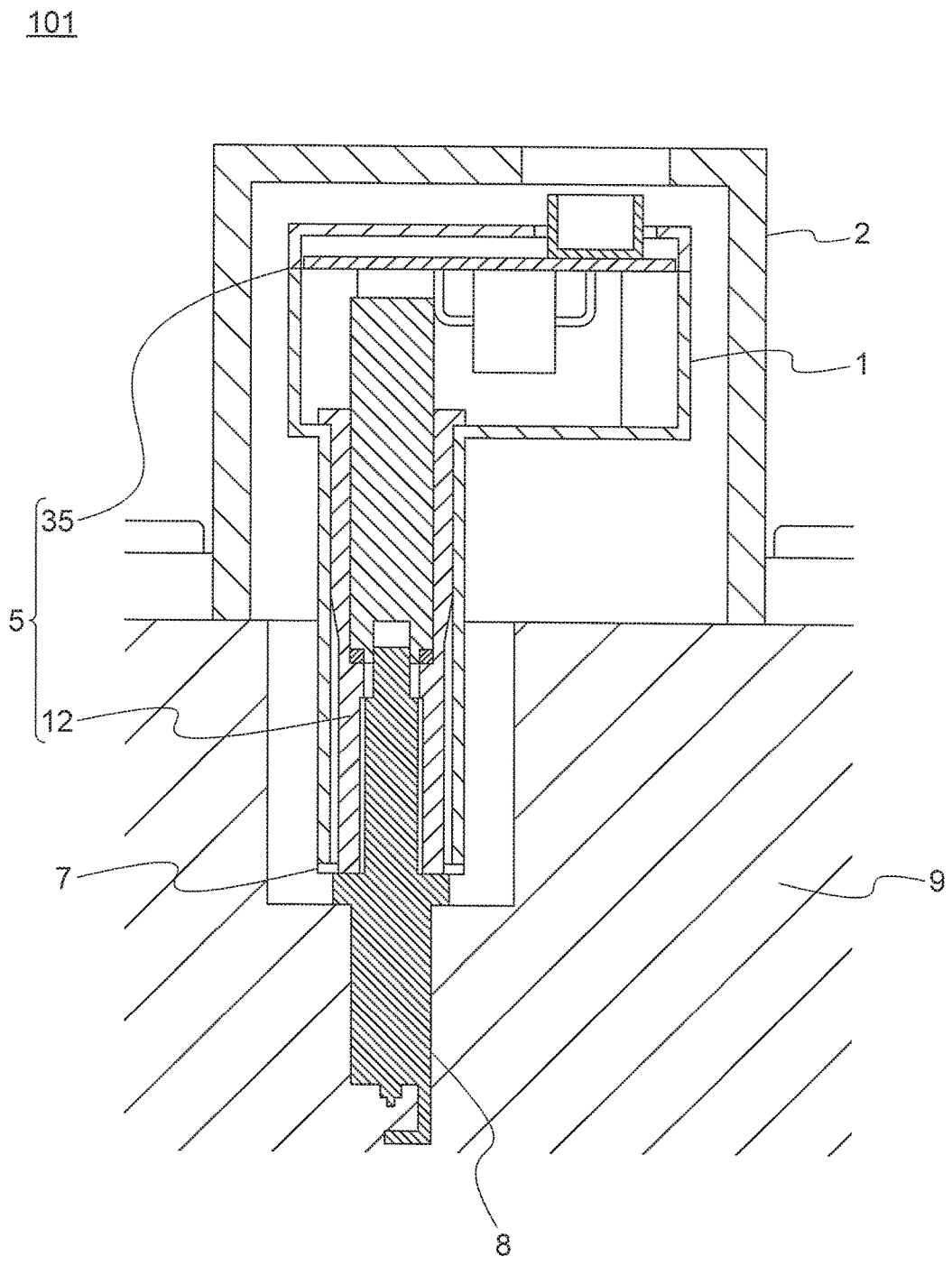
FIG. 4 is a cross-sectional view taken along the line IV-IV shown in FIG. 3.

FIG. 3 is a top view of the high frequency discharge ignition device 101, and FIG. 4 is a cross-sectional view taken along the line IV-IV shown in FIG. 3.

As shown in FIG. 4, the spark plug 8 is attached to the engine block 9. The spark plug 8 is directly attached to the coupling circuit 35 by the protector 12. Further, a connecting member 7 is sandwiched between the spark plug 8 and the first housing 1.

In addition, the second housing 2 is fixed to the female threaded portions 14 in the engine block 9 by the flange holes 13 and the bolts 6.

Next, an electrical pathway of the high frequency discharge ignition device 101 will be described with reference to FIG. 4.

The first housing 1 is electrically connected to the spark plug 8 via the connecting member 7. For this reason, the electrical potential of the first housing 1 is equal to 0 V, i.e. ground potential. In other words, the first housing 1 is grounded and, as a result, the first radiation noise N1 generated from the coupling circuit 35 is shielded by the first housing 1.

Figure 5:
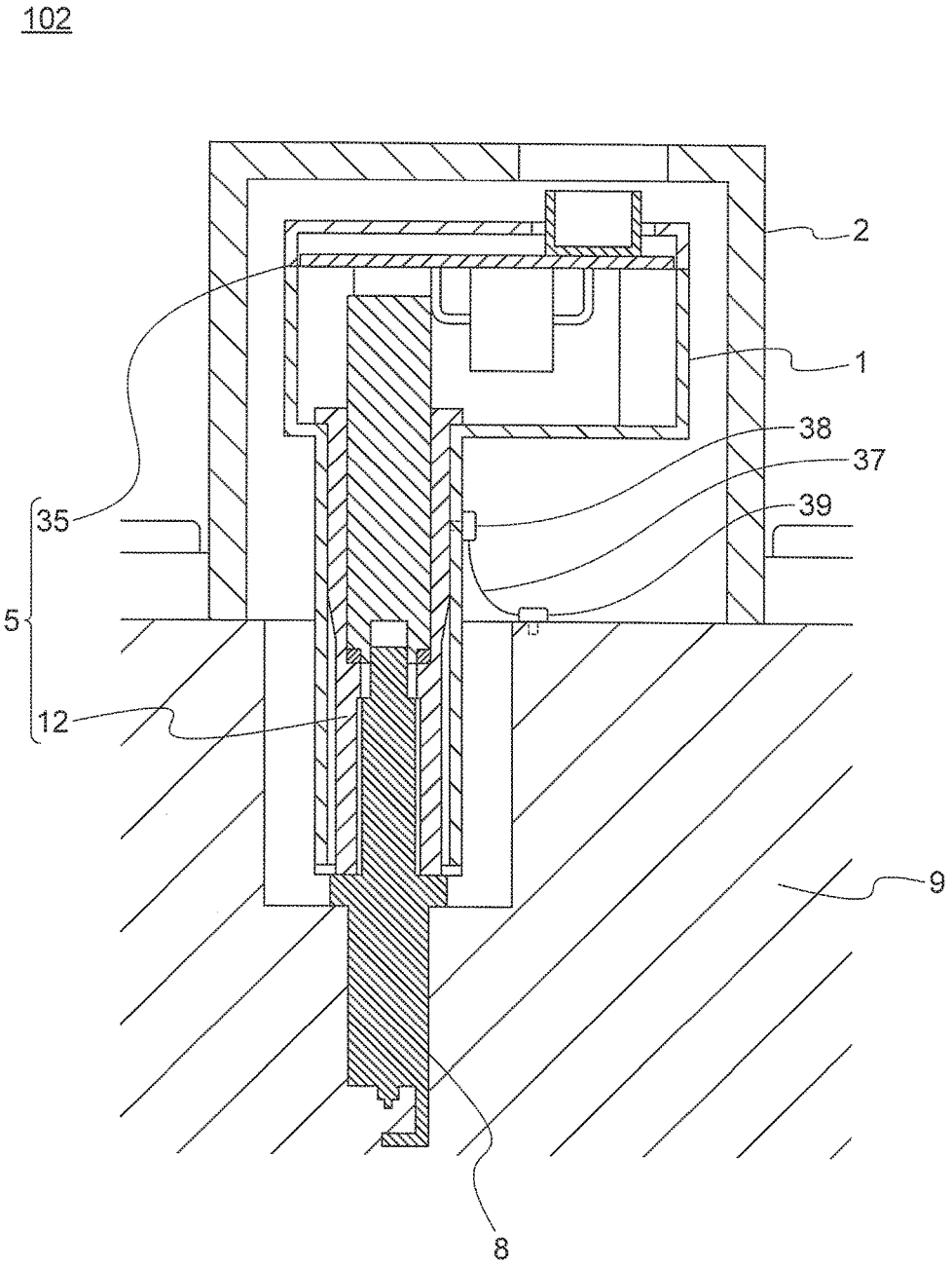
FIG. 5 is a cross-sectional view showing a modification of FIG. 4.

The first housing 1 is grounded by being connected to the spark plug 8, however, as shown in FIG. 5, the first housing 1 may also be grounded by a metal lead wire 37 that is fixed to the first housing 1 by a screw 38 and is fixed to the engine block 9 by a screw 39.

The second housing 2 is fixed so as not to come into contact with the first housing 1, that is, a gap is disposed therebetween. Further, the second housing 2 is connected to the engine block 9. Accordingly, the second housing 2 is grounded. As a result, the second radiation noise N2 caused by the capacitive component C2 between the coupling circuit 35 and the first housing 1 is shielded by the second housing 2.

Here, if the second housing 2 comes into contact with even a part of the first housing 1, the first housing 1 will be electrically integrated with the second housing 2. As a result, the capacitive discharge current that flows between the coupling circuit 35 and the first housing 1 passes through this contact point and also flows into the second housing 2 and the engine block 9. Accordingly, the second radiation noise N2 is radiated to the outside from the outer surface of the second housing 2 and the surface of the engine block 9. In other words, if the second housing 2 comes into contact with the first housing 1, the second housing 2 becomes ineffective at shielding the second radiation noise N2.

Note that the first housing 1 and the second housing 2 are both grounded and have the same electrical potential. Accordingly, no capacitive discharge current flows through the capacitive component C2 between the first housing 1 and the second housing 2, and the third radiation noise N3 does not occur.

Figure 6:
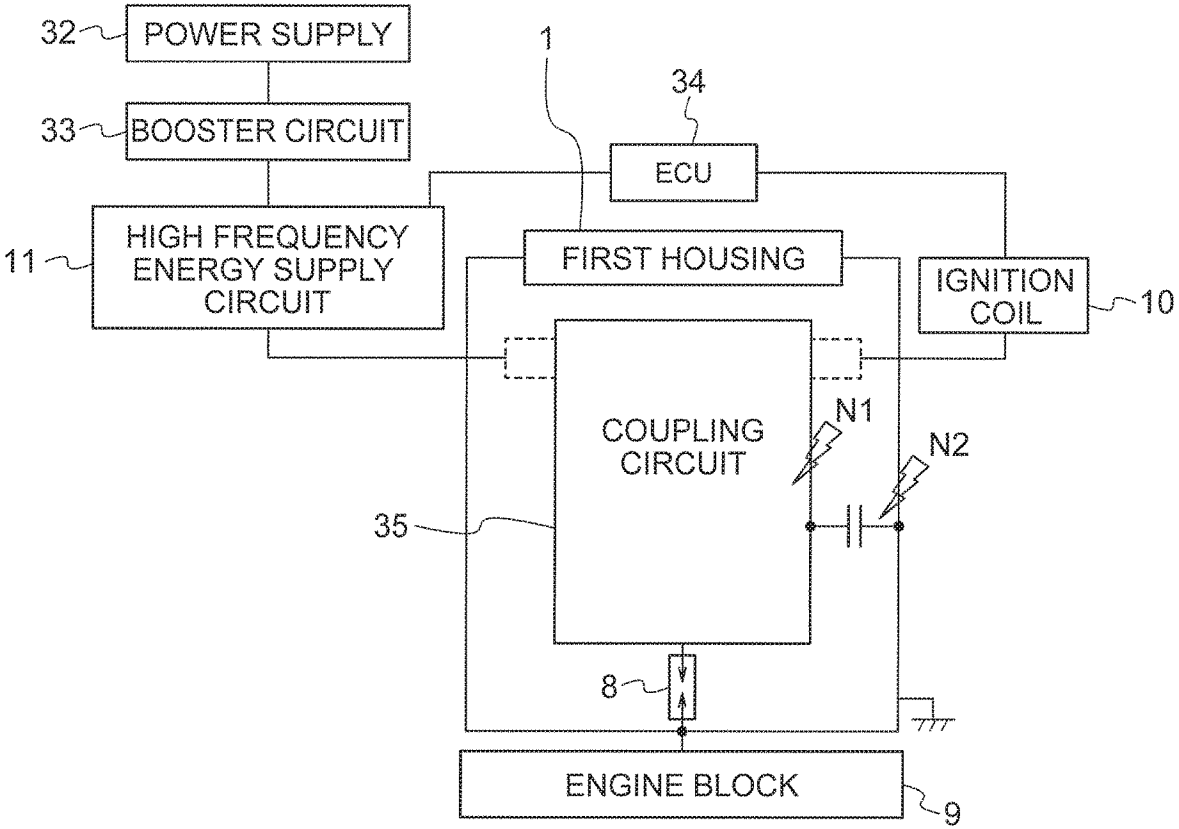
FIG. 6 is provided to explain the effect of the first embodiment, and is a block diagram showing a circuit configuration of a high frequency discharge ignition device in which no second housing to enclose the first housing is provided.

FIG. 6 is a block diagram showing a circuit configuration of a high frequency discharge ignition device in which no second housing is provided so as to enclose the first housing. In FIG. 6, the coupling circuit 35 is built into the first housing 1. As the first housing 1 is grounded, the first radiation noise N1 generated by the coupling circuit 35 is shielded by the first housing 1. However, as there is no second housing provided so as to enclose the first housing 1, the second radiation noise N2 generated due to the capacitive component C1 between the coupling circuit 35 and the first housing 1 is not shielded, and is radiated to the outside of the first housing 1.

As described above, the high frequency discharge ignition device 101 according to the first embodiment couples and supplies, to the spark plug 8 connected to the engine block 9, high frequency energy supplied from the high frequency energy supply circuit 11 and a high voltage pulse supplied from the ignition coil 10. The high frequency discharge ignition device 101 includes the output device 5 which includes the coupling circuit 35 for supplying coupled energy to the spark plug 8, the first housing 1 in which the output device 5 is housed, and the second housing 2 which is connected to the engine block 9, the output device 5 being directly attached to the spark plug 8, the first housing 1 and the second housing 2 being respectively formed from metal, the first housing 1 being grounded, the first housing 1 being enclosed in the second housing 2, and the first housing 1 being separated from the second housing 2 such that a gap is disposed therebetween.

Hence, a high frequency discharge ignition device can be provided in which the influence of radiation noise on peripheral devices thereof is reduced.

In addition, the first housing 1 is grounded by being electrically connected to the spark plug 8 or the engine block 9. As a result, the distance to ground from the first housing 1 is shortened, and the pathway which passes from the coupling circuit 35, through the spark plug 8, the engine block 9 (ground), the first housing 1, and back to the coupling circuit 35 is shortened. For this reason, generation of the second radiation noise N2 due to a capacitance between the coupling circuit 35 and the first housing 1 can be suppressed.

Second Embodiment

Next, a high frequency discharge ignition device according to a second embodiment will be described with reference to FIG. 7. In the high frequency discharge ignition device according to the second embodiment, a coupling circuit is built into an inner housing.

Figure 7:
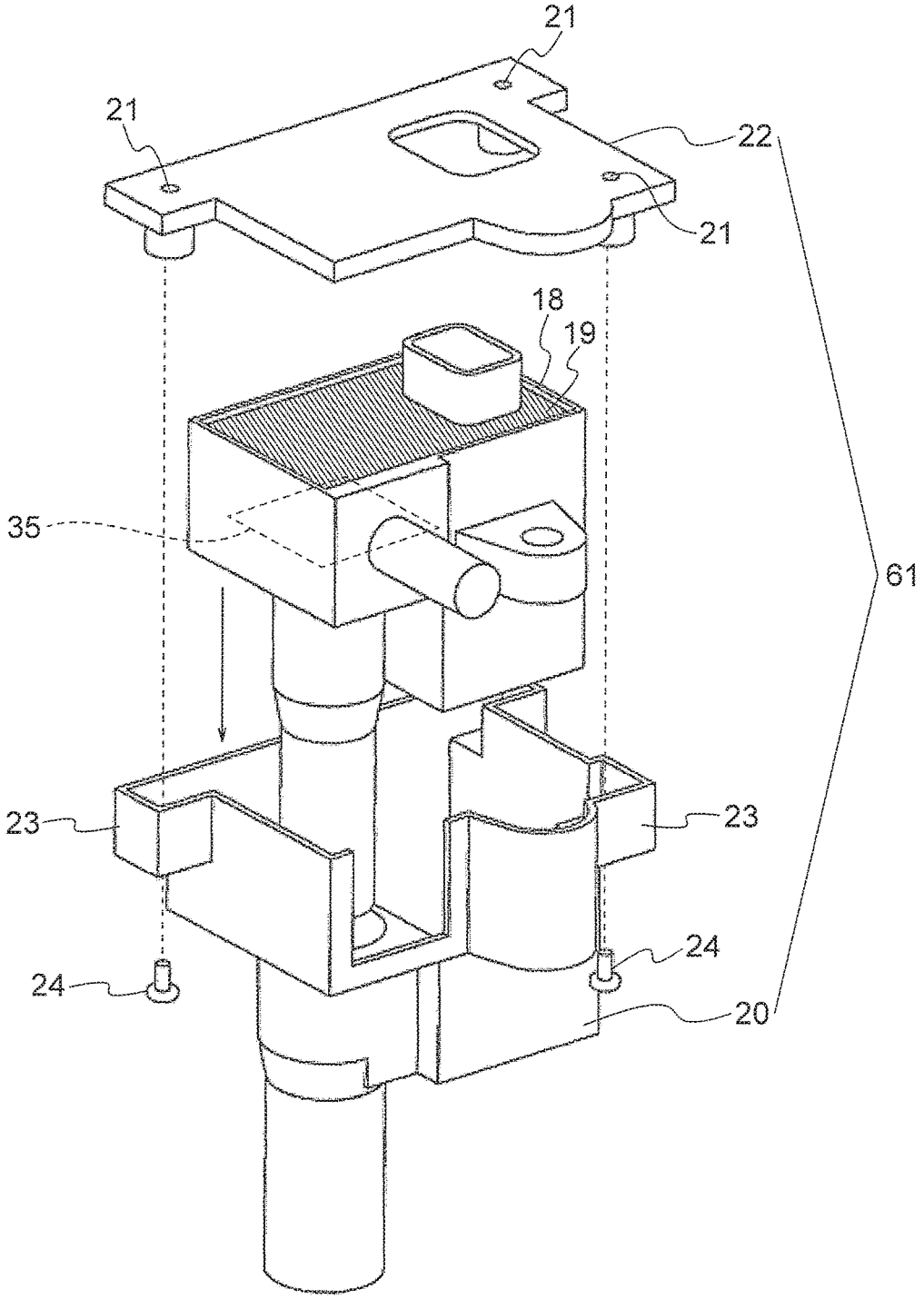
FIG. 7 is an exploded perspective view of a first housing in a high frequency discharge ignition device according to a second embodiment of the present invention.

FIG. 7 is a perspective view showing a configuration of a first housing in the high frequency discharge ignition device according to the second embodiment. A coupling circuit 35 is screwed into an interior of a resin inner housing 18. The interior of the inner housing 18 is then fixed in place by a casting resin 19. In other words, the inner housing 18 is resin-molded. The inner housing 18, the interior of which has been fixed in place by the casting resin, is inserted into a metal base 20. A metal cover 22 provided with hole portions 21 is fixed by screws 24 to flange holes 23 provided on the base 20. The base 20 and the cover 22 constitute a first housing 61.

At this time, a method is conceivable in which the coupling circuit 35 is fixed directly, i.e. without using the inner housing 18, into the metal first housing 61 using the casting resin. However, depending on the material used for the casting resin, the casting resin may fail to adhere to the metal and come off. In such a case, the coupling circuit 35 would not be fixed in place. However, when the resin inner housing 18 is used, as in the second embodiment, such a situation, i.e. the casting resin 19 coming off, does not occur, such that the coupling circuit 35 is fixed inside the inner housing 18.

Figure 8:
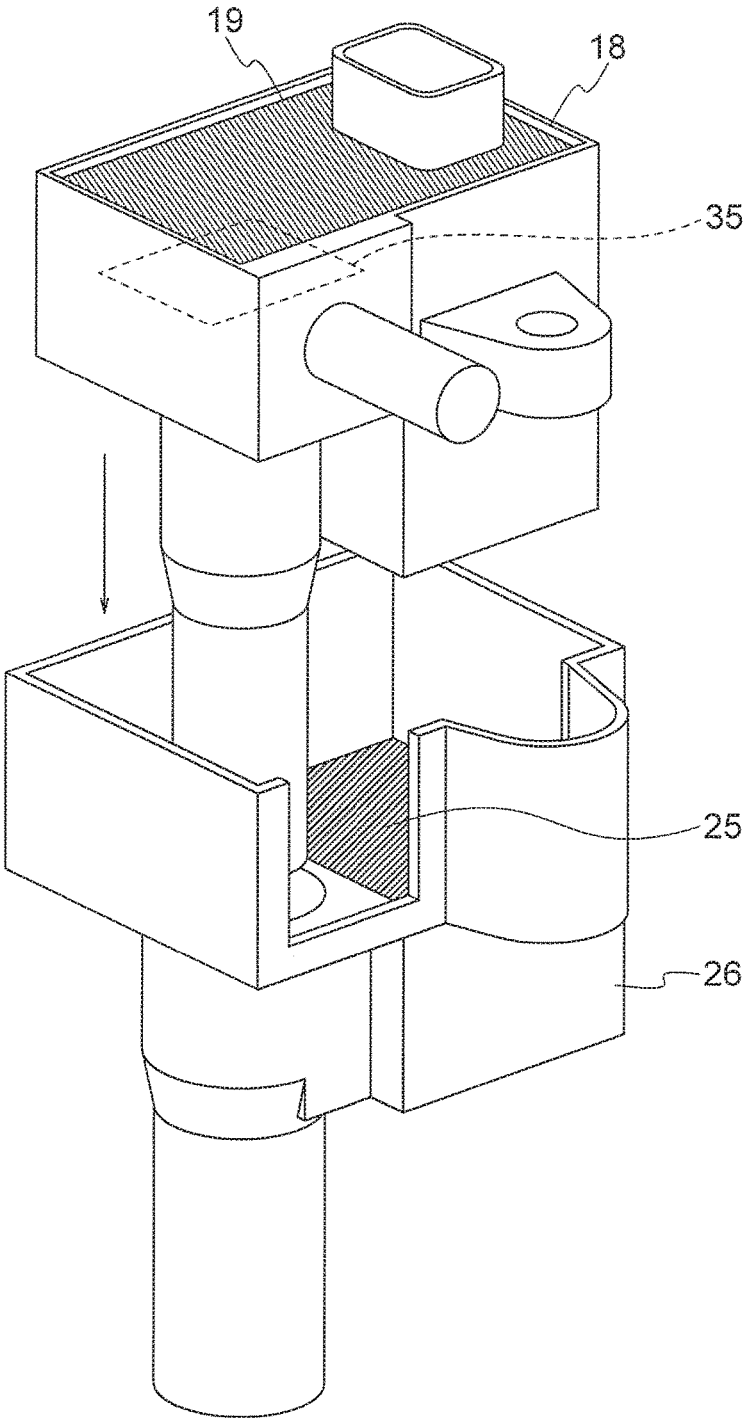
FIG. 8 is an exploded perspective view of a first housing in a high frequency discharge ignition device according to a modification of the second embodiment.

Next, a modification will be described with reference to FIG. 8. FIG. 8 is a perspective view showing the configuration of a first housing of a high frequency discharge ignition device according to a modification of the second embodiment. As shown in FIG. 8, the resin inner housing 18 into which the coupling circuit 35 is built is fixed to a metal base 26 using an adhesive 25. The base 26 constitutes the first housing.

As described above, in the high frequency discharge ignition device according to the second embodiment, the coupling circuit 35 is resin-molded into the resin inner housing 18, and the inner housing 18 is housed in the first housing 61 or 26. As a result, the insulating properties of the coupling circuit 35, with which an internal circuit thereof has a high voltage of around 30 to 40 kV, can be improved.

Third Embodiment

Next, a high frequency discharge ignition device according to the third embodiment will be described with reference to FIG. 9. In the first embodiment, the high frequency energy supply circuit is provided separately to the high frequency discharge ignition device, however, in the third embodiment, the high frequency energy supply circuit is incorporated into the high frequency discharge ignition device.

Figure 9:
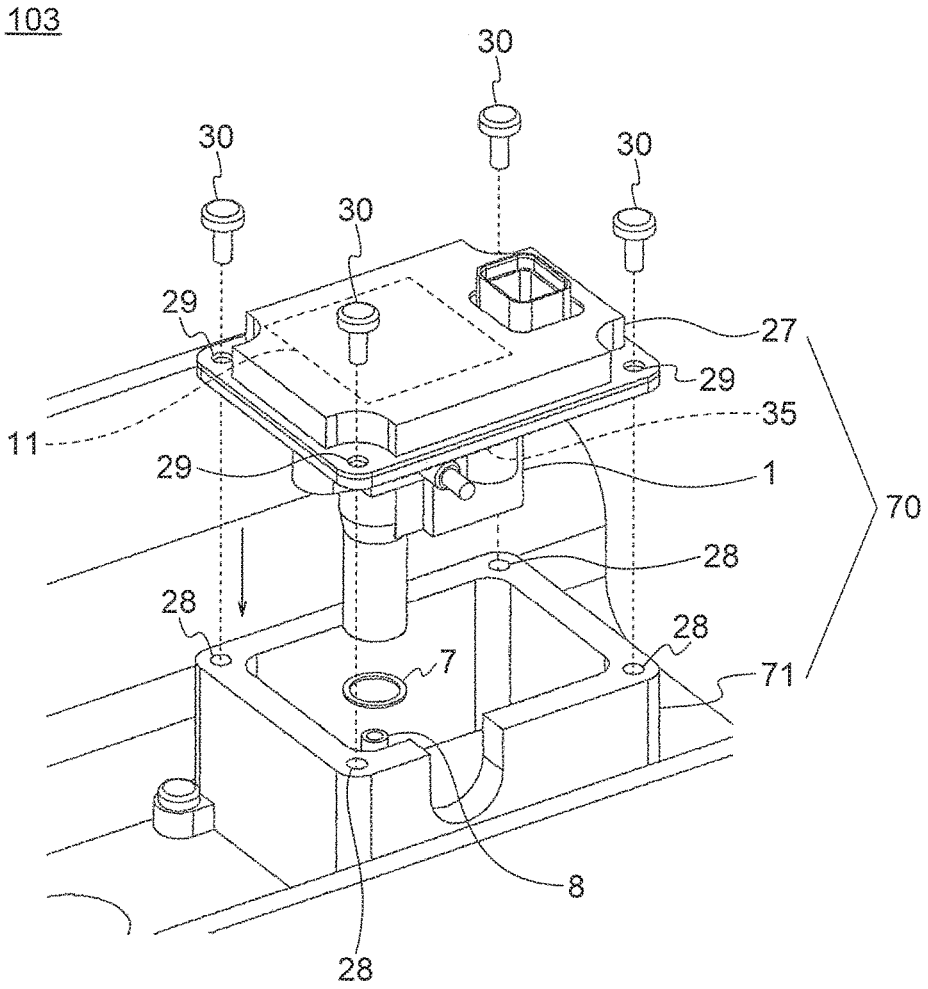
FIG. 9 is an exploded perspective view of a high frequency discharge ignition device according to a third embodiment of the present invention.

FIG. 9 is a perspective view showing the configuration of a high frequency discharge ignition device 103 according to the third embodiment. As shown in FIG. 9, a first housing 1 is mounted on a spark plug 8 via a connecting member 7. A coupling circuit 35 is built into the first housing 1. The connecting member 7 is formed from metal and has a ring shape.

A second housing 70 is provided so as to enclose the first housing 1. The second housing 70 includes a cover portion 27 and a main body portion 71, which, when combined, form a box shape. A high frequency energy supply circuit 11 is built into the cover portion 27. Flange holes 29 are provided at four corners of the cover portion 27. The main body portion 71 is provided with female threaded portions 28 positioned at four corners thereof which correspond to the flange holes 29. Bolts 30 pass through the flange holes 29 and are fastened to the female threaded portions 28, whereby the cover portion 27 is fixed to the main body portion 71.

As described above, in the high frequency discharge ignition device 103 according to the third embodiment, the second housing 70 includes the main body portion 71 and the cover portion 27, and the high frequency energy supply circuit 11 is built into the cover portion 27. As a result, a length of wiring through which high frequency energy conducts from the high frequency energy supply circuit 11 to the coupling circuit 35 can be shortened, such that noise generated from the wiring can be reduced. Moreover, as the length of the wiring is shortened, the range over which shielding is applied to the high frequency discharge ignition device 103 can be reduced, with the result that noise becomes easy to deal with.

Further, the cover portion 27 is fixed to the main body portion 71. As a result, vibration resistance of the high frequency energy supply circuit 11, which is built into the cover portion 27, can be improved.

Fourth Embodiment

Next, a high frequency discharge ignition device according to the fourth embodiment will be described with reference to FIG. 10. In the high frequency discharge ignition device according to the fourth embodiment, a second housing is provided with opening portions for heat dissipation in addition to harness holes.

Figure 10:
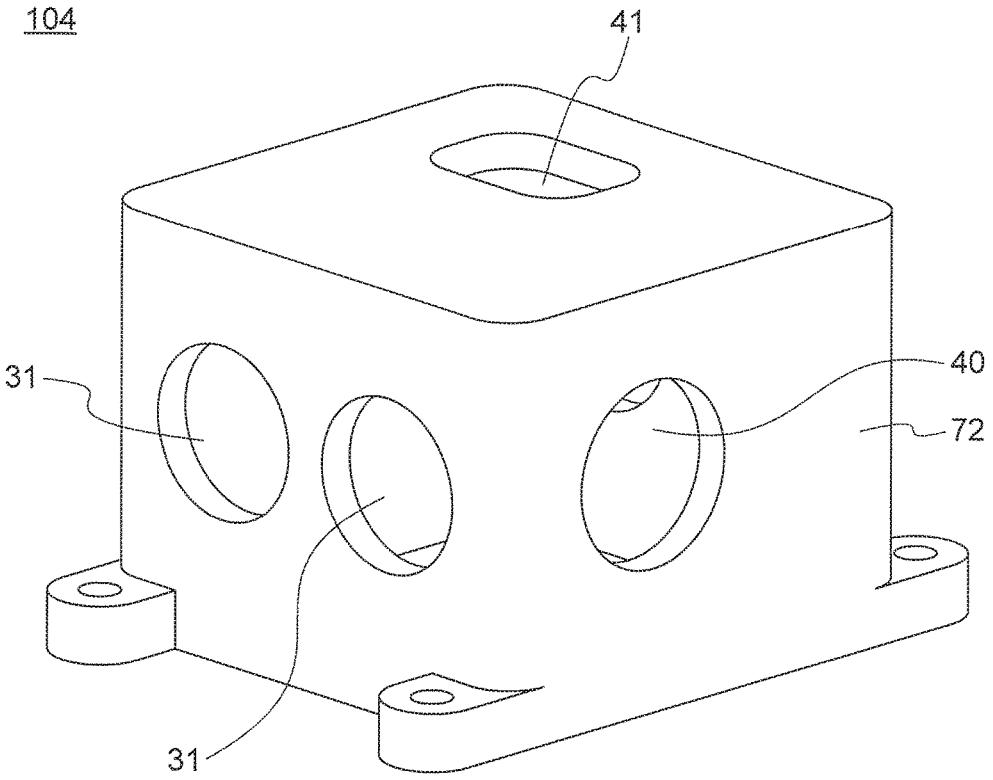
FIG. 10 is a perspective view of a high frequency discharge ignition device according to a fourth embodiment of the present invention.

FIG. 10 is a perspective view showing the configuration of a high frequency discharge ignition device 104 according to the fourth embodiment. As shown in FIG. 10, two circular opening portions 31 are provided in addition to holes 40 and 41 through which harnesses 17 and 16 pass, in a second housing 72. The opening portions 31 allow a space between the first housing 1 and the second housing 72 to communicate with the outside of the second housing 72. Heat generated inside the second housing 72 can escape to the outside of the second housing 72 through the opening portions 31. The opening portions 31 form ventilation holes.

Note that, as there is concern regarding noise leakage from the opening portions 31, the permissible size and number of the opening portions 31 are determined by the method described below.

First, a permissible noise level is determined in accordance with a standard set by the Japanese Radio Law. A difference between the determined noise level and current noise level is set as a margin S [dB]. Shielding properties are expressed by the following equation (1).

$$S=20\times\log\{150/f/l/\sqrt{n}\} \quad (1)$$

Here, when the wavelength of radio waves of a frequency used f [MHz] is w [m], the diameter l [m] of the opening portions 31 is determined by $$l\leq w/2.$$

Accordingly, by substituting the margin S [dB], the frequency f [MHz] and l [m] into equation (1), the permissible number n of opening portions 31 can be calculated.

An example is given below. Assuming the frequency of radio waves used for ETC (Electronic Toll Collection) wireless communication f=3000 MHz, the wavelength thereof w is around 0.1 m, so the diameter l of the opening portions 31 will be no more than 0.05 m. If the margin is −3 dB and l=0.05 m, then, according to equation (1), n will be approximately 2. In other words, it is indicated that, when the permissible noise level is set to −3 dB, up to two opening portions 31 having a diameter of 0.05 m may be provided in the second housing 72.

As described above, in the high frequency discharge ignition device 104 according to the fourth embodiment, the second housing 72 is provided with the opening portions 31. As a result, heat inside the second housing 72 can escape.

What is claimed is:

1. A high frequency discharge ignition device in which high frequency energy supplied from a high frequency energy supply circuit is coupled to a high voltage pulse supplied from an ignition coil and supplied to a spark plug connected to an engine block, the high frequency discharge ignition device comprising:

an output device that includes a coupling circuit supplying the coupled energy to the spark plug;

a first housing in which the output device is housed; and a second housing that is connected to the engine block, the second housing and the engine block being formed separately from each other, wherein the output device is directly attached to the spark plug, the first housing and the second housing are respectively formed from metal, the first housing is grounded, the first housing is enclosed in the second housing, and the first housing is separated from the second housing by a gap such that the first housing is not in electrical contact with the second housing in a portion other than through the engine block.

2. The high frequency discharge ignition device according to claim 1, wherein the first housing is grounded by being electrically connected to the spark plug or the engine block.

3. The high frequency discharge ignition device according to claim 1, wherein the coupling circuit is resin-molded inside a resin inner housing, and the inner housing is housed in the first housing.

4. The high frequency discharge ignition device according to claim 2, wherein the coupling circuit is resin-molded inside a resin inner housing, and the inner housing is housed in the first housing.

5. The high frequency discharge ignition device according to claim 1, wherein the second housing includes a main body portion and a cover portion, and the high frequency energy supply circuit is built into the cover portion.

6. The high frequency discharge ignition device according to claim 2, wherein the second housing includes a main body portion and a cover portion, and the high frequency energy supply circuit is built into the cover portion.

7. The high frequency discharge ignition device according to claim 3, wherein the second housing includes a main body portion and a cover portion, and the high frequency energy supply circuit is built into the cover portion.

8. The high frequency discharge ignition device according to claim 4, wherein the second housing includes a main body portion and a cover portion, and the high frequency energy supply circuit is built into the cover portion.

9. The high frequency discharge ignition device according to claim 5, wherein the cover portion is fixed to the main body portion.

10. The high frequency discharge ignition device according to claim 6, wherein the cover portion is fixed to the main body portion.

11. The high frequency discharge ignition device according to claim 7, wherein the cover portion is fixed to the main body portion.

12. The high frequency discharge ignition device according to claim 8, wherein the cover portion is fixed to the main body portion.

13. The high frequency discharge ignition device according to claim 1, wherein a ventilation hole is provided in the second housing.

14. The high frequency discharge ignition device according to claim 2, wherein a ventilation hole is provided in the second housing.

15. The high frequency discharge ignition device according to claim 3, wherein a ventilation hole is provided in the second housing.

16. The high frequency discharge ignition device according to claim 4, wherein a ventilation hole is provided in the second housing.

17. The high frequency discharge ignition device according to claim 5, wherein a ventilation hole is provided in the second housing.

18. The high frequency discharge ignition device according to claim 6, wherein a ventilation hole is provided in the second housing.

19. The high frequency discharge ignition device according to claim 7, wherein a ventilation hole is provided in the second housing.

20. The high frequency discharge ignition device according to claim 12, wherein a ventilation hole is provided in the second housing.

* * * * *